US010415804B2

(12) United States Patent
Wronski et al.

(10) Patent No.: US 10,415,804 B2
(45) Date of Patent: Sep. 17, 2019

(54) LUMINAIRE MOUNTING SYSTEM

(71) Applicant: Cooper Technologies Company, Houston, TX (US)

(72) Inventors: Grzegorz Wronski, Peachtree City, GA (US); Jared Michael Davis, Newnan, GA (US); Barton Kirk Ideker, Fayetteville, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/789,682

(22) Filed: Oct. 20, 2017

(65) Prior Publication Data

US 2018/0112857 A1 Apr. 26, 2018

Related U.S. Application Data

(60) Provisional application No. 62/411,086, filed on Oct. 21, 2016.

(51) Int. Cl.

| | |
|---|---|
| ***F21V 15/00*** | (2015.01) |
| ***F21V 17/00*** | (2006.01) |
| ***F21V 21/04*** | (2006.01) |
| ***H01F 7/02*** | (2006.01) |
| ***F21V 21/096*** | (2006.01) |
| *F21S 8/02* | (2006.01) |

(52) U.S. Cl.
CPC ..... *F21V 21/04* (2013.01); *F21V 21/096* (2013.01); *H01F 7/0205* (2013.01); *F21S 8/026* (2013.01)

(58) Field of Classification Search
USPC ..... 362/364
See application file for complete search history.

(56) References Cited

U.S. PATENT DOCUMENTS

| | | | | |
|---|---|---|---|---|
| 7,145,179 | B2 | 12/2006 | Petroski | |
| 7,361,910 | B2 * | 4/2008 | Ono | G03B 27/42 250/492.2 |
| 7,549,235 | B2 * | 6/2009 | Alders | G01B 3/1084 33/760 |
| 8,128,264 | B2 | 3/2012 | Genenbacher | |
| 8,454,204 | B1 | 6/2013 | Chang et al. | |
| 2010/0068899 | A1 * | 3/2010 | Shvili | F21V 19/006 439/39 |
| 2015/0362159 | A1 * | 12/2015 | Ludyjan | F21V 23/06 362/277 |
| 2017/0082253 | A1 * | 3/2017 | Sorensen | E04B 9/006 |

* cited by examiner

*Primary Examiner* — Tuyen K Vo
(74) *Attorney, Agent, or Firm* — King & Spalding LLP

(57) ABSTRACT

A lighting system includes a housing and a finishing section. The housing defines a cavity and includes at least one magnet mounted inside the cavity. The finishing section includes a second magnet mounted adjacent to a side of the finishing section and oriented so that the second magnet and the first magnet attract each other when the finishing section is inserted into the housing.

15 Claims, 14 Drawing Sheets

400
200
120
110
150
310
100
140
130
311
100
37

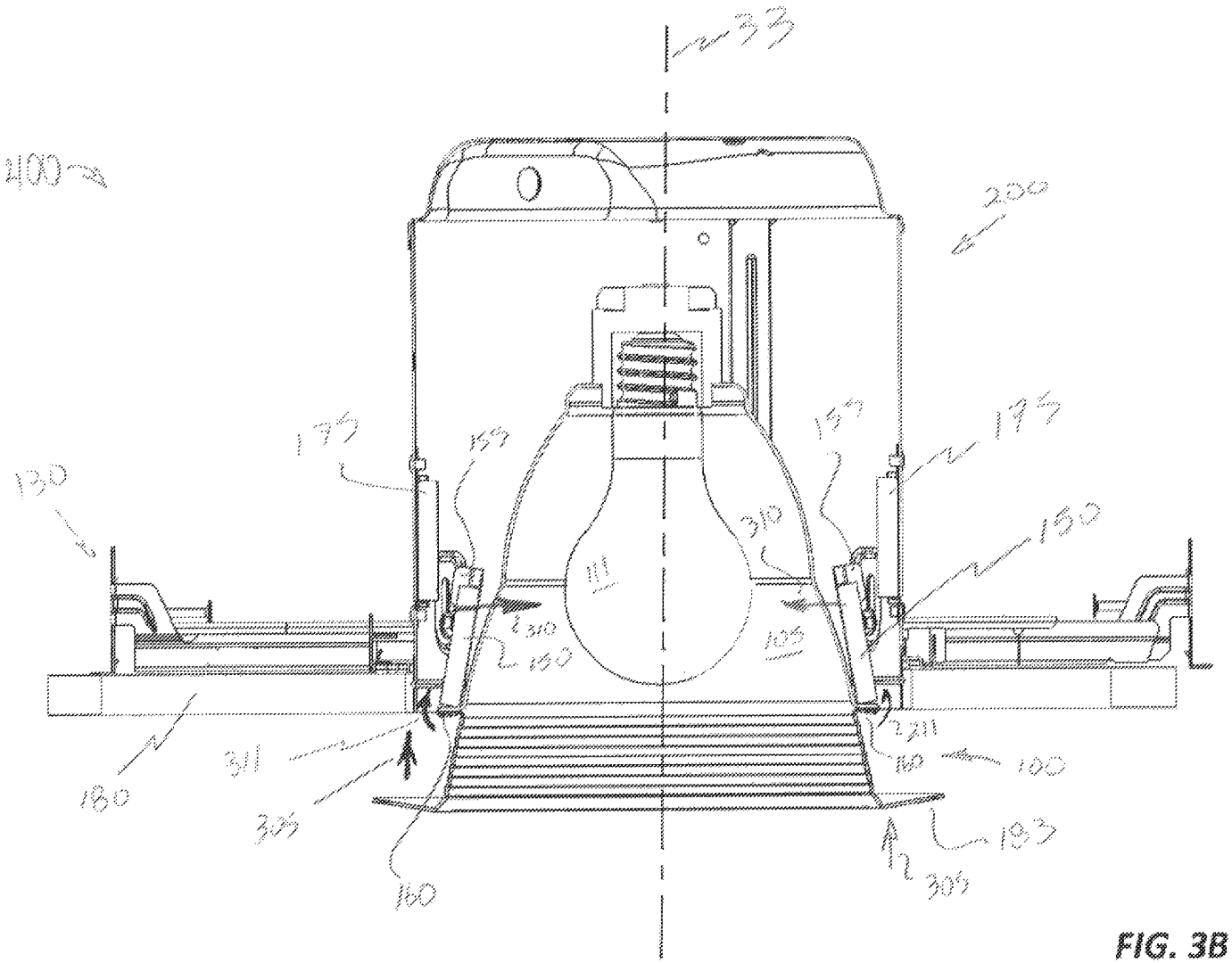
200
222
142
160
100
187
205
110
211
190
180
205
31
180
100
100
100

LUMINAIRE MOUNTING SYSTEM

PRIORITY CLAIM

The present application claims priority under 35 U.S.C. § 119(e) to U.S. Provisional Patent Application No. 62/411,086, filed Oct. 21, 2016, and titled "Luminaire Mounting System," the entire contents of which are incorporated herein by reference.

TECHNICAL FIELD

Embodiments of the technology relate generally to illumination systems and more particularly to a luminaire mounting system for mounting a finishing section in a housing, such as a housing that is recessed in a ceiling.

BACKGROUND

Lighting systems, such as recessed luminaires, often include a housing into which a finishing section is installed. The finishing section can include a light source and a trim. The finishing section can be secured within the recessed housing using a variety of mechanisms such as torsion springs and friction clips. In some cases, magnets have been used to secure the finishing section within the recessed housing as an alternative to torsions springs or friction clips. However, the use of magnets to secure a finishing section within a housing can have certain challenges. For example, magnets typically must be precisely aligned in order to properly secure the finishing section within the housing. Furthermore, alignment of the magnets can be challenging when encountering ceilings of varying thicknesses. Accordingly, an improved system of magnets used to retain a finishing section within a recessed housing of a lighting system would be advantageous.

SUMMARY

In one aspect, the present disclosure relates to a lighting system that comprises a housing with a cavity having an opening at a bottom of the cavity and a finishing section sized for insertion into the cavity of the housing. A first magnet is mounted in the cavity of the housing so that a first pole of the first magnet is oriented towards the opening of the cavity. A second magnet is mounted to the finishing section so that a second pole of the second magnet is oriented toward a top of the cavity when the finishing section is installed in the cavity. The first pole and the second pole repel each other.

In another aspect, the disclosure relates to a lighting system that comprises a housing with a cavity having a bottom end and a top end, the cavity sized to receive at least a rear portion of a finishing section. The housing also has a first magnet with opposing magnetic polarities at opposite first and second ends. The first magnet is mounted in the cavity so that the first end is oriented towards the bottom end and the second end is oriented towards the top end of the housing. The finishing section comprises the rear portion, a light source, an aperture for emitting light produced by the light source, a side that extends between the rear portion and the aperture, and a second magnet that comprises a third end and a fourth end having opposing magnetic polarities, wherein the second magnet is mounted adjacent the side of the finishing section with the third end oriented towards the aperture of the finishing section and the fourth end oriented towards the rear portion of the finishing section. The first end of the first magnet and the fourth end of the second magnet have common magnetic polarities so as to repel one another.

In yet another aspect, the disclosure relates to a lighting system that comprises a housing with a cavity and a finishing section sized for insertion in the cavity. A first magnet comprises a first north end and a first south end and is attached to the housing. A second magnet comprises a second north end a second south end and is attached to the finishing section. When the finishing section is inserted into the cavity, the first magnet initially repels the second magnet and as the finishing section is inserted farther into the cavity, the first magnet attracts the second magnet with magnet force thereby pulling the finishing section farther into the cavity.

These and other aspects will be described further in the example embodiments set forth herein.

BRIEF DESCRIPTION OF THE FIGURES

The foregoing and other features and aspects of the present disclosure are best understood with reference to the following description of certain example embodiments, when read in conjunction with the accompanying drawings, wherein:

FIGS. 3A, 3B, and 3C illustrate side cross-sectional views of the finishing section progressively inserted into the housing in accordance with example embodiments of the present disclosure.

Figure 1:
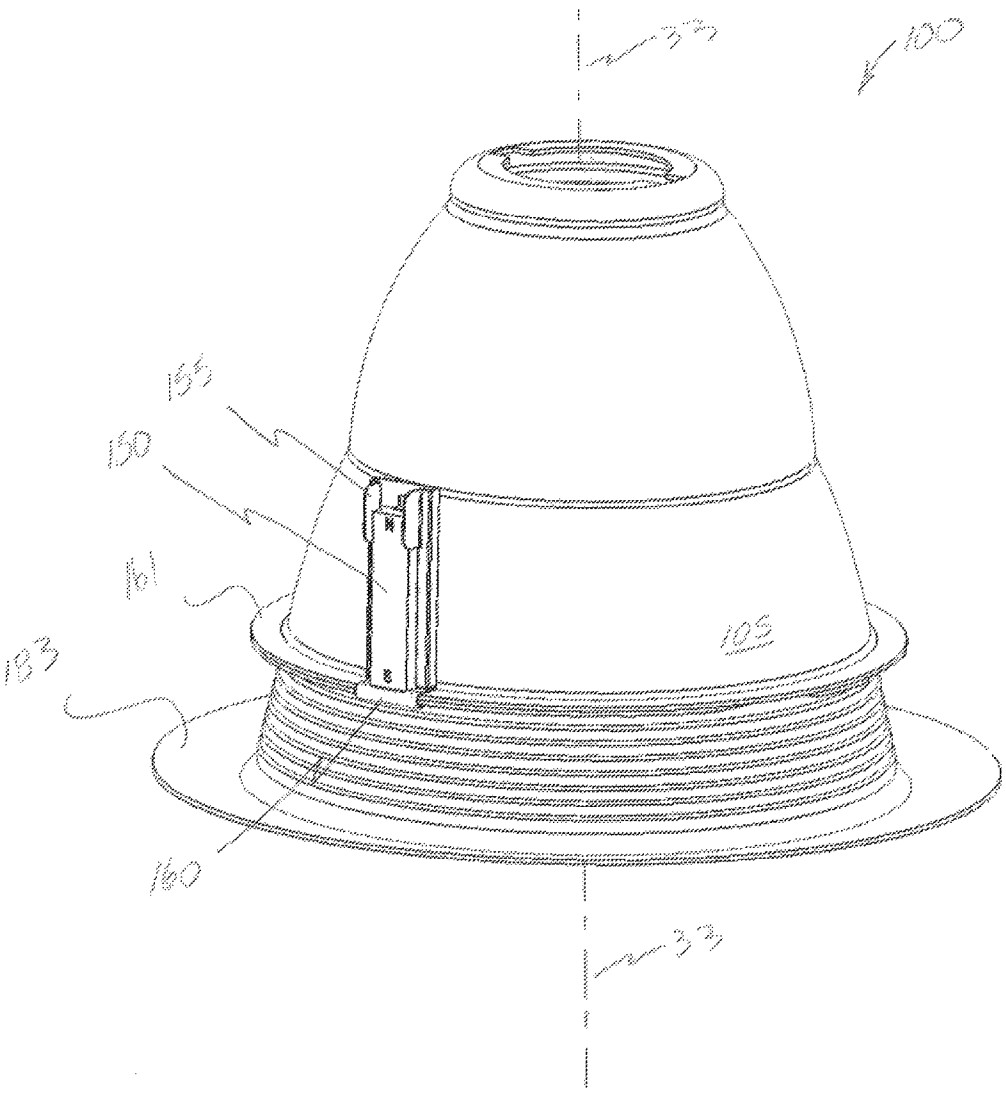
FIG. 1 illustrates a side perspective view of a finishing section for a lighting system in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

In the foregoing figures showing example embodiments of lighting systems, one or more of the components shown may be omitted, repeated, and/or substituted. Accordingly, the example embodiments of lighting systems should not be considered limited to the specific arrangements of components shown in any of the figures. For example, features shown in one or more figures or described with respect to one embodiment can be applied to another embodiment associated with a different figure or description.

DETAILED DESCRIPTION OF EXAMPLE EMBODIMENTS

A luminaire mounting system can facilitate mounting a finishing section (for example lighting trim or a reflector that may have an associated light source) in a housing that may be recessed in a ceiling. The mounting system can accommodate variable thicknesses of ceilings and can provide uniform force against a ceiling surface, for example.

In some example embodiments and as further discussed below, two magnets can be mounted in fixed positions within the recessed housing with the magnet's north pole oriented upward. The magnet length can be proportional to a range of motion for the housing and finishing section, for example about two inches. A second set of magnets can be mounted to the finishing section, for example using a clip or spring device that allows those magnets to pivot. The magnet mount can further comprise a guide in some embodiments. When the south poles of the finishing section magnets are brought near the south poles of the housing magnets, the magnets can repel one another. The repelling force can cause the finishing section magnets to pivot away from the housing magnets. Pivoting the finishing section magnets away can allow the finishing section magnet to move past the housing magnets. As the finishing section is moved into the ceiling and the two opposing magnetic poles pass one another, the south poles of the finishing section magnets can begin to be attracted to the north poles of the housing magnets. Thus, the repelling magnetic force can transition or give way to magnetic attraction. The attraction magnetic force can pull the finishing section assembly into the ceiling.

Some representative embodiments will be described more fully hereinafter with example reference to the accompanying drawings that illustrate embodiments of the technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art. FIGS. 1, 2, 3, and 4 illustrate an embodiment of a luminaire mounting system. FIGS. 5, 6, and 7 respectively illustrate schematic diagrams for three other embodiments of a luminaire mounting system.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positions may be exaggerated to help visually convey certain principles. In the drawings, similar reference numerals among different figures designate like or corresponding, but not necessarily identical, elements.

Turning now to FIGS. 1, 2, 3, and 4, these figures describe a luminaire or lighting system 400 that comprises a luminaire mounting system according to some example embodiments of the disclosure. As further described below, the lighting system 400 comprises a finishing section 100 that is inserted into a housing 200 during lighting system installation.

FIG. 1 illustrates a side perspective view of an example finishing section 100 of the example lighting system 400 shown in FIGS. 2, 3, and 4 in accordance with some embodiments of the disclosure.

Figure 2A:
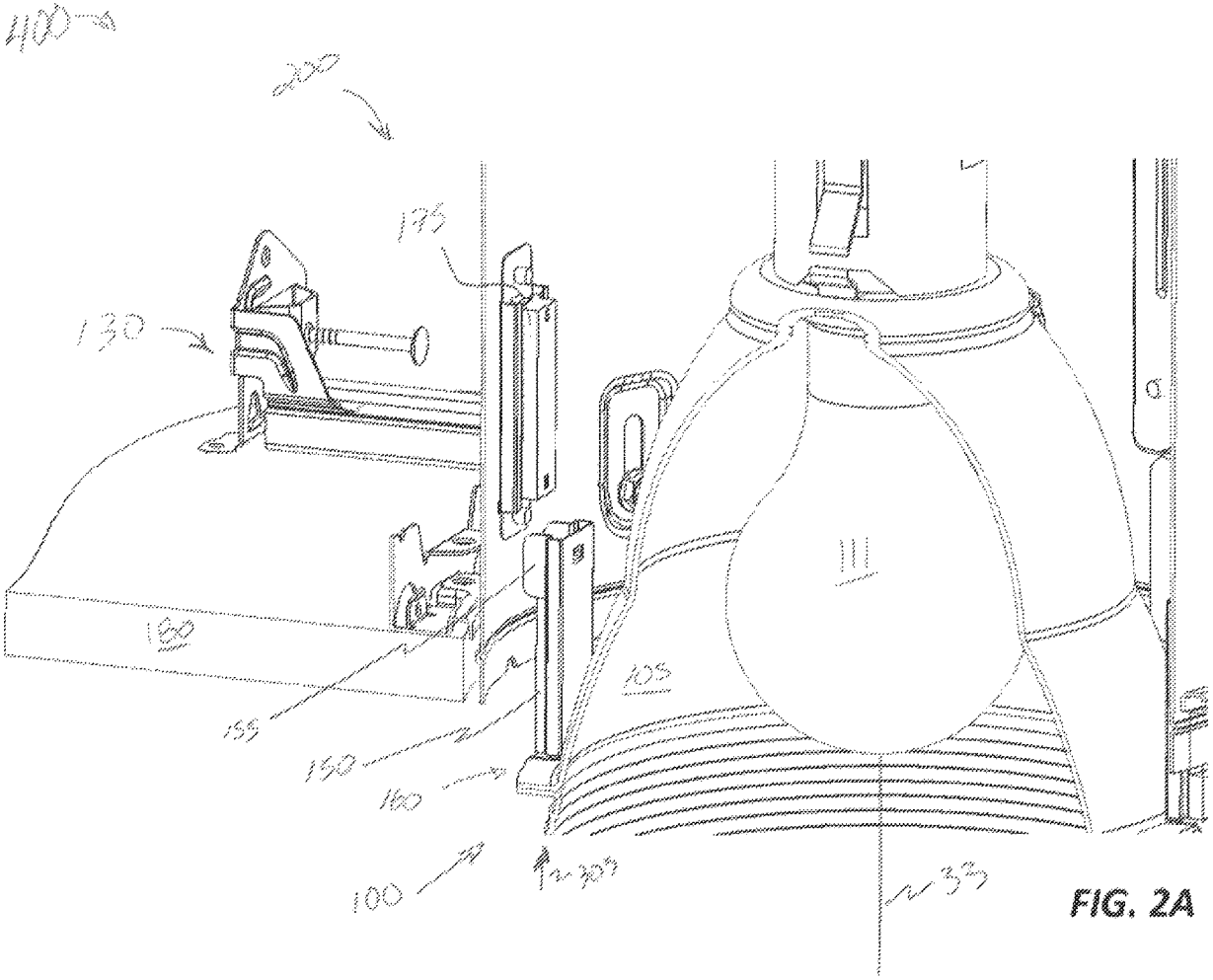
FIGS. 2A, 2B, and 2C illustrate perspective cross-sectional views of the finishing section of FIG. 1 and an associated housing in accordance with example embodiments of the present disclosure.
Figure 2B:
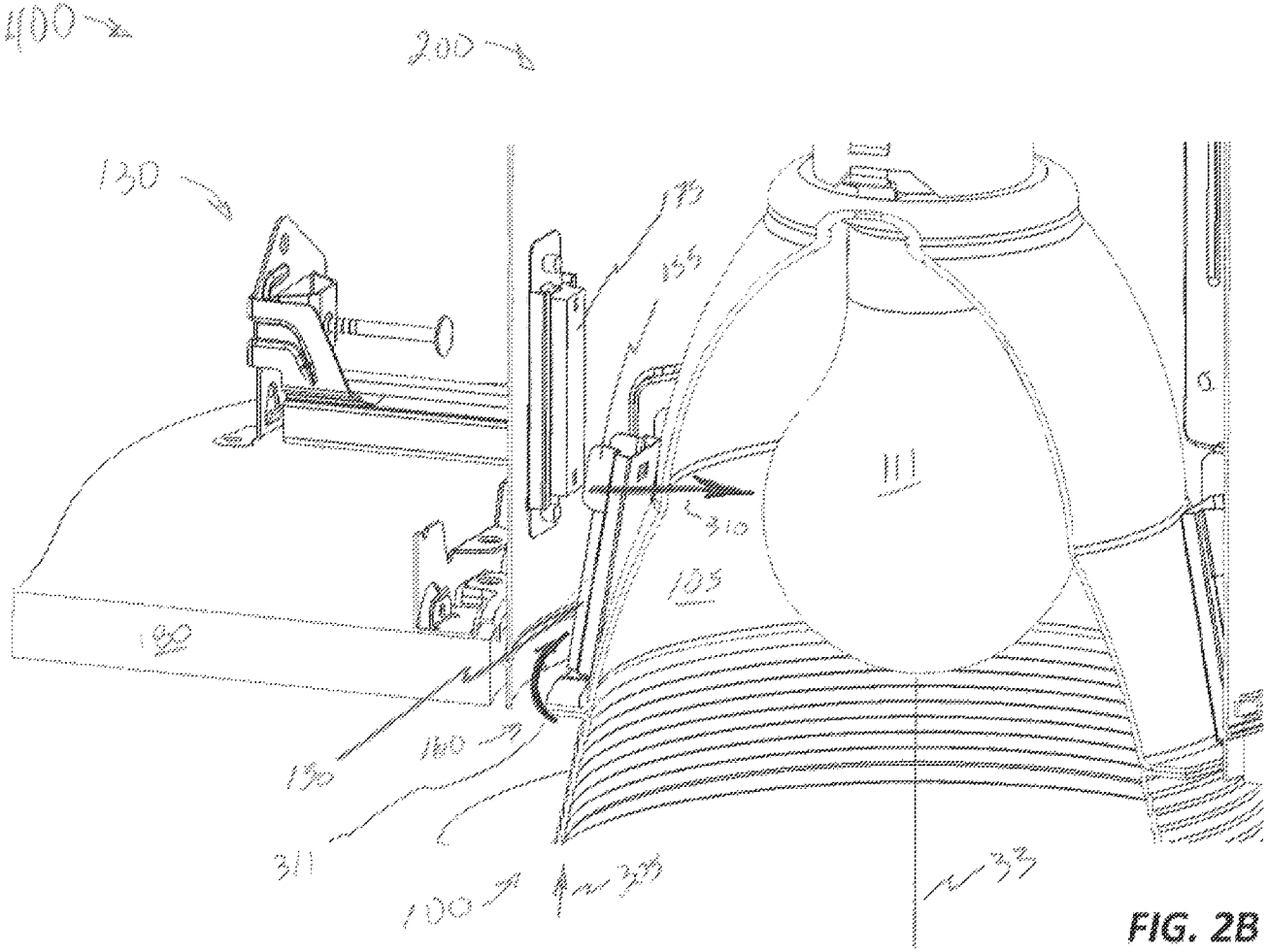
Figure 2C:
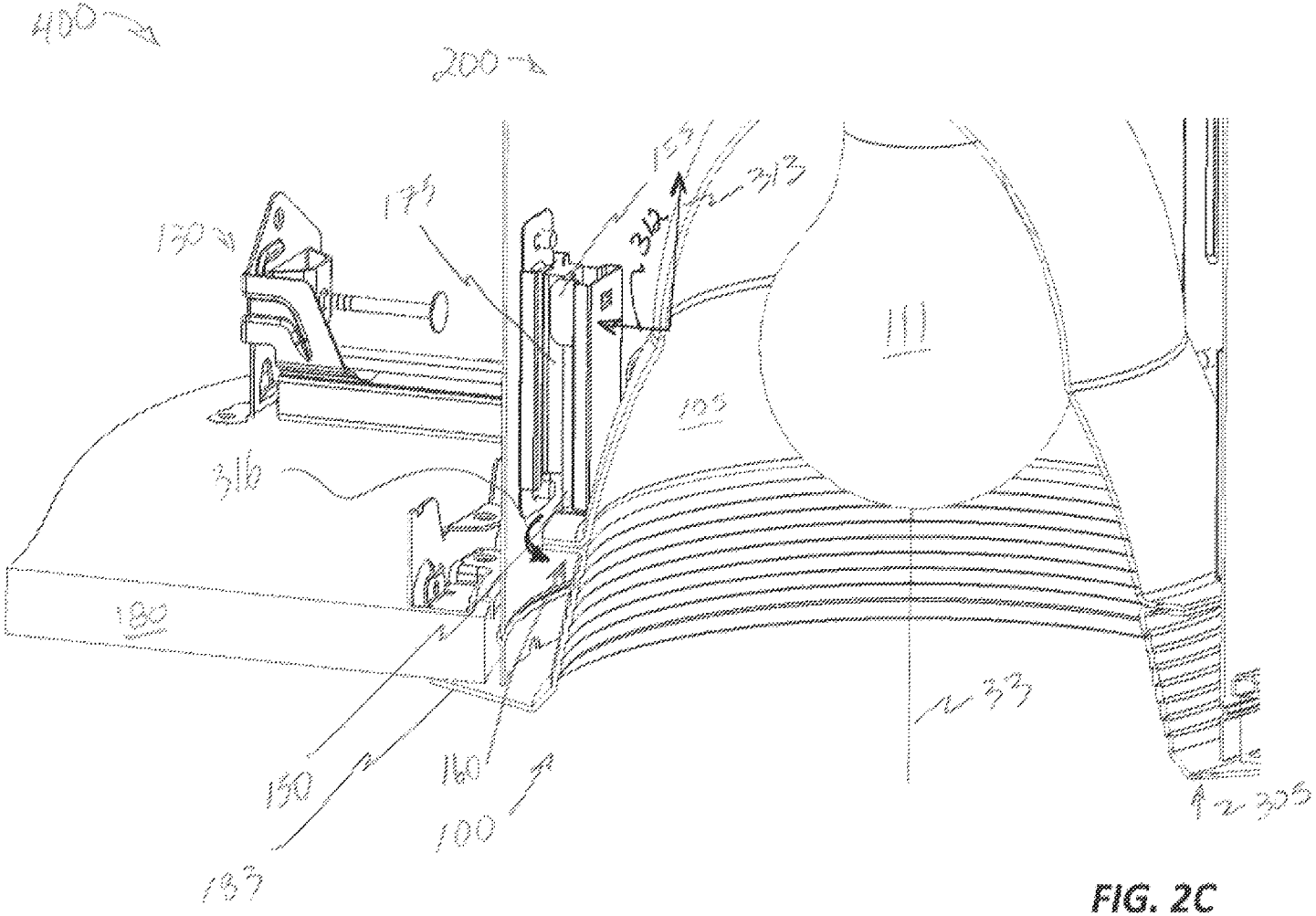

FIGS. 2A, 2B, and 2C (collectively FIG. 2) illustrate cutaway perspective views of the finishing section 100 and an associated recessed housing 200 of the lighting system 400, with the recessed housing 200 adjacent an aperture of a ceiling 180 in accordance with some example embodiments of the disclosure. FIGS. 2A, 2B, and 2C illustrate the finishing section 100 progressively inserted into the housing 200. More specifically, FIG. 2A illustrates the finishing section 100 at an initial stage of insertion in the housing 200, FIG. 2B at a further stage of finishing section insertion, and FIG. 2C as fully inserted.

Figure 3A:
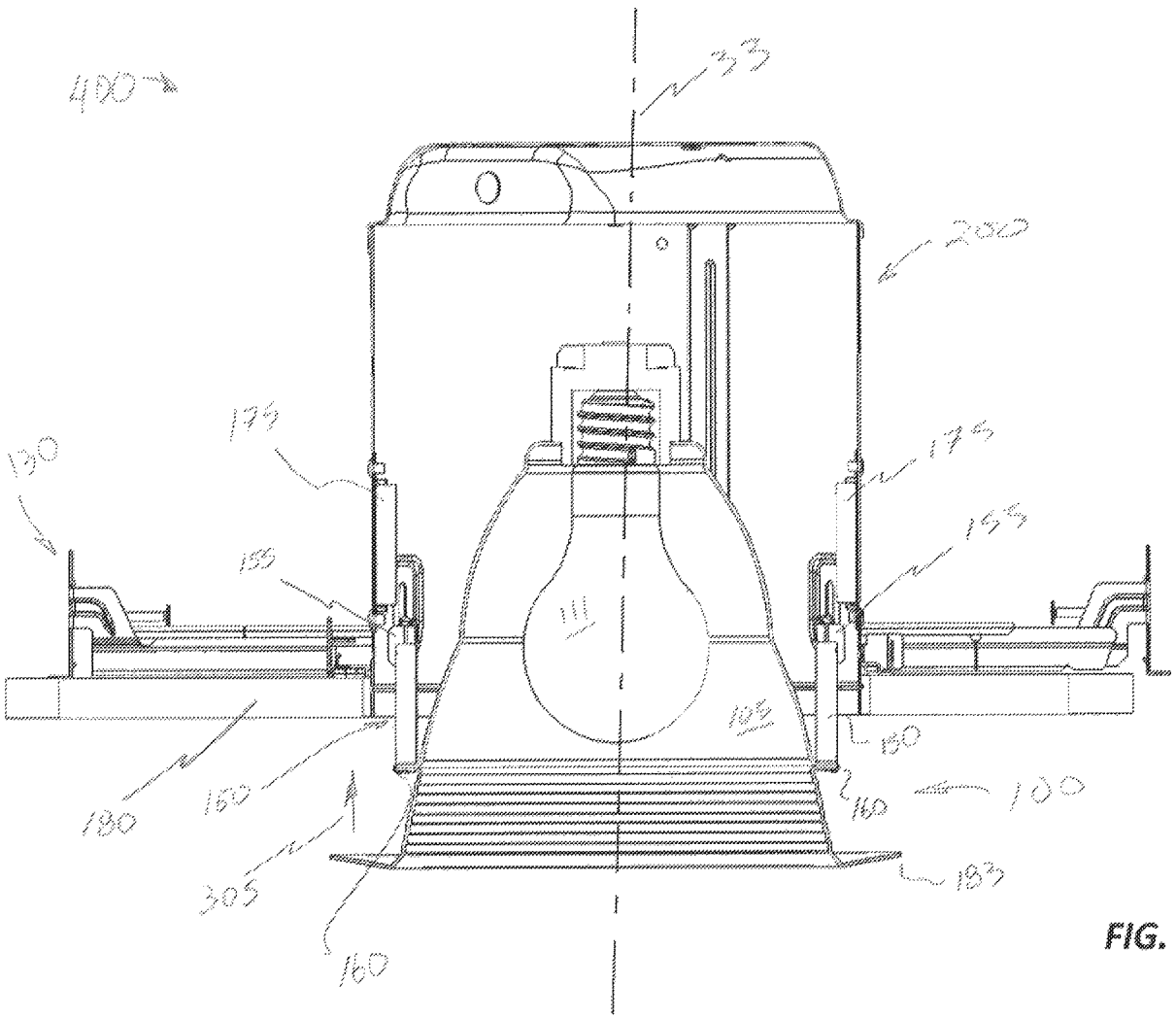
Figure 3C:
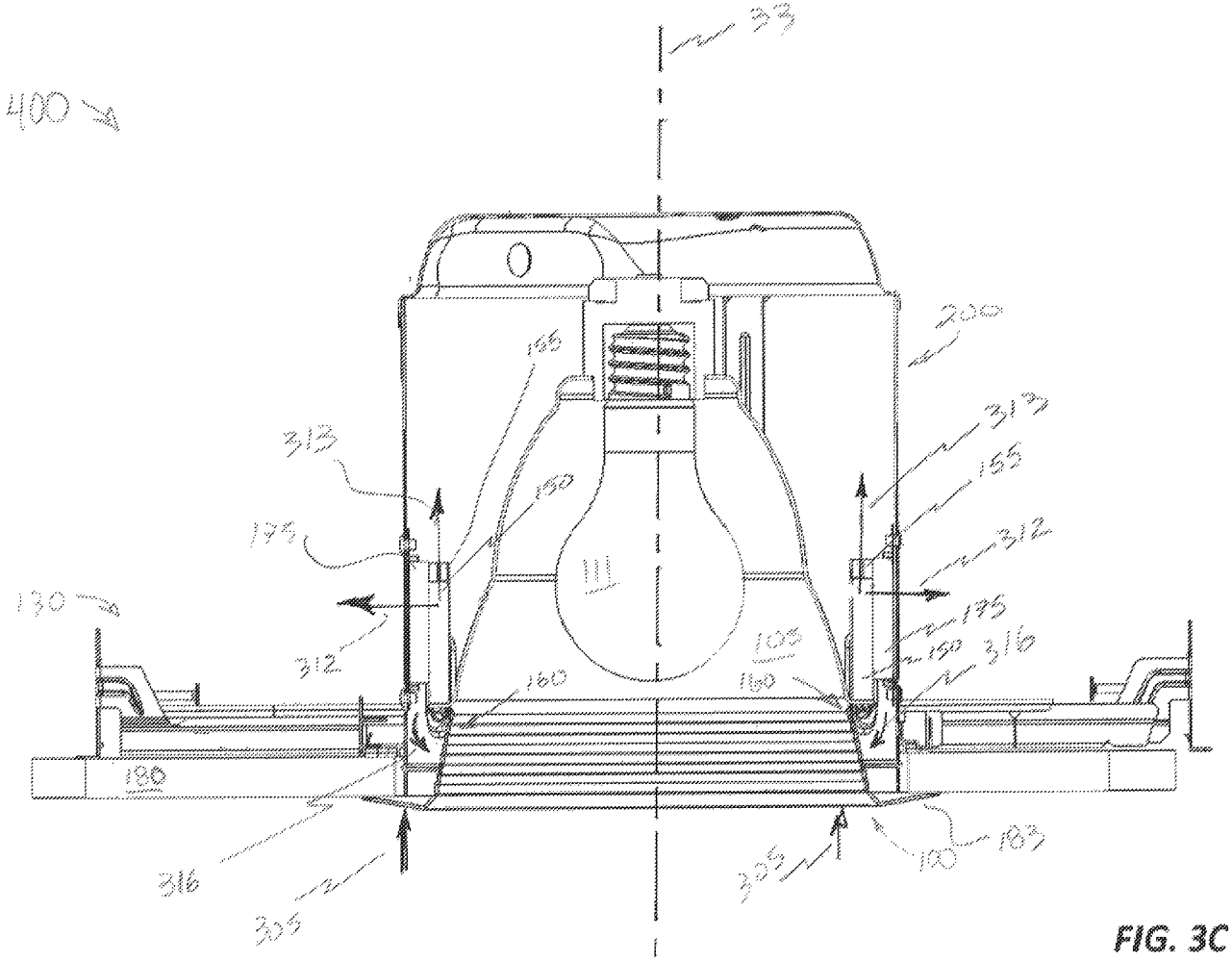

FIGS. 3A, 3B, and 3C (collectively FIG. 3) illustrate a side cutaway view of the finishing section 100 progressively inserted in the housing 200 in accordance with some example embodiments of the disclosure. FIG. 3A corresponds to FIG. 2A, FIG. 3B corresponds to FIG. 2B, and FIG. 3C corresponds to FIG. 2C. Thus, FIG. 3A illustrates the finishing section 100 at an initial stage of insertion in the housing 200, FIG. 3B at a further stage of finishing section insertion, and FIG. 3C as fully inserted.

Figure 4A:
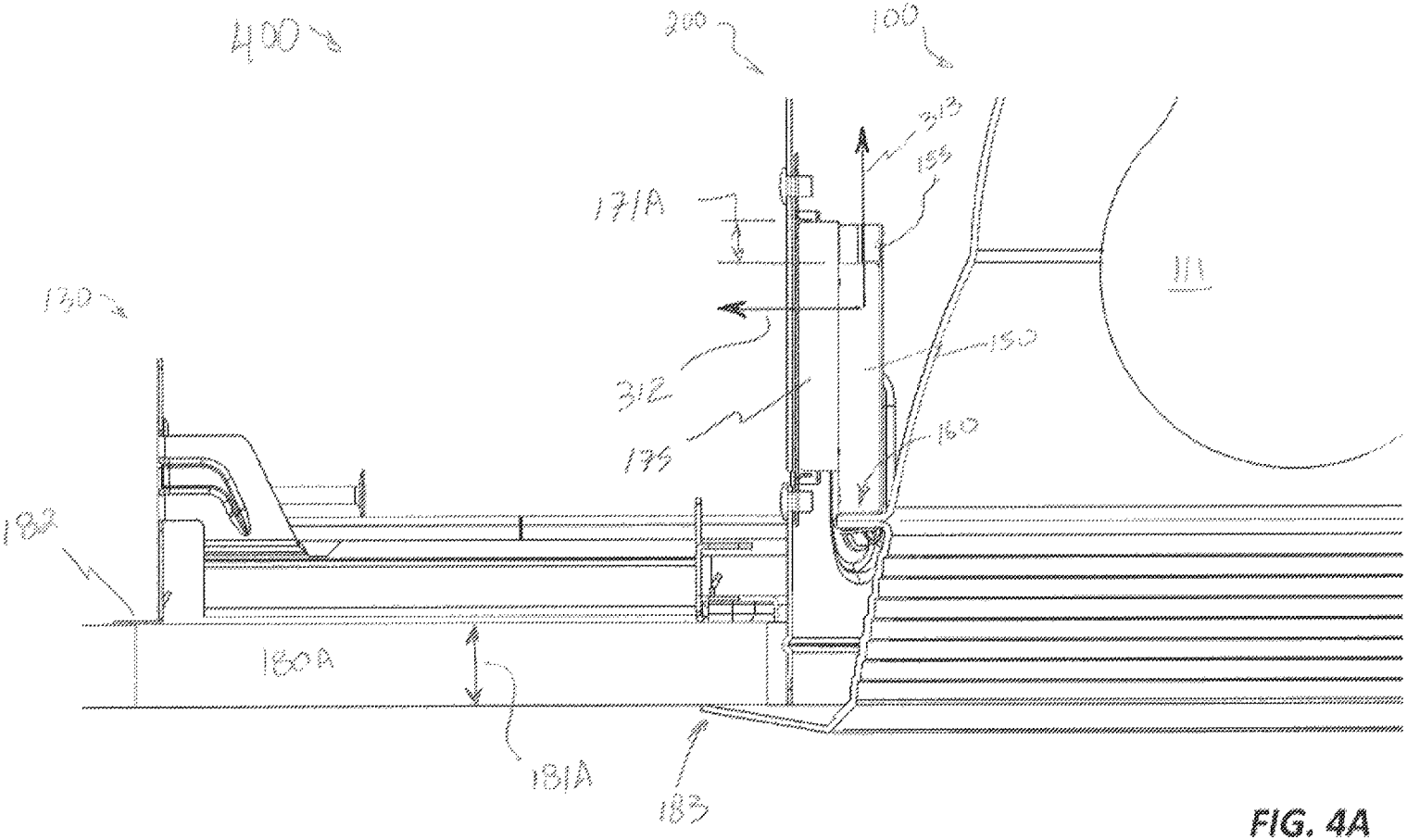
FIGS. 4A, 4B, and 4C illustrate the lighting system mounted to three different ceilings of differing thicknesses in accordance with example embodiments of the present disclosure.
Figure 4B:
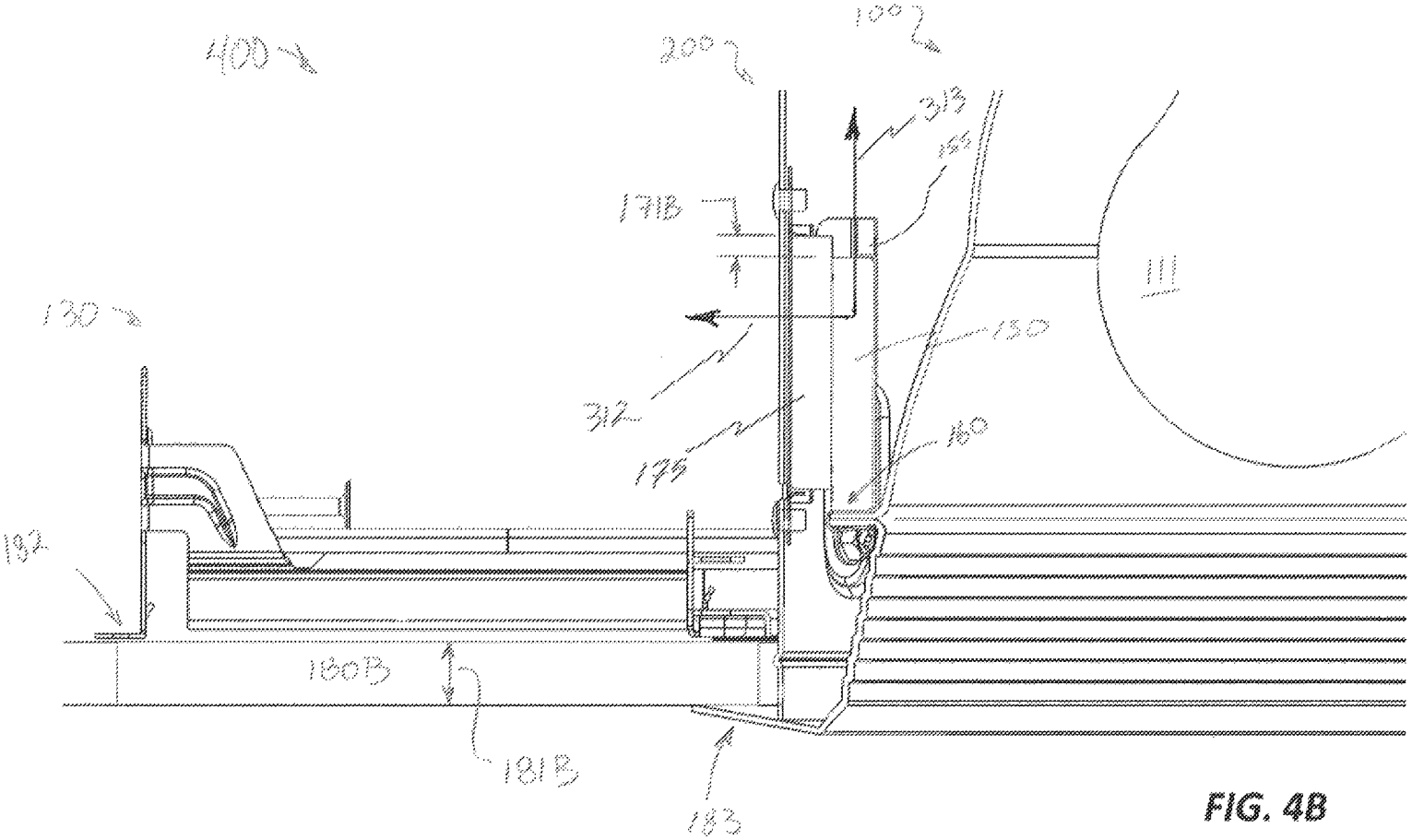
Figure 4C:
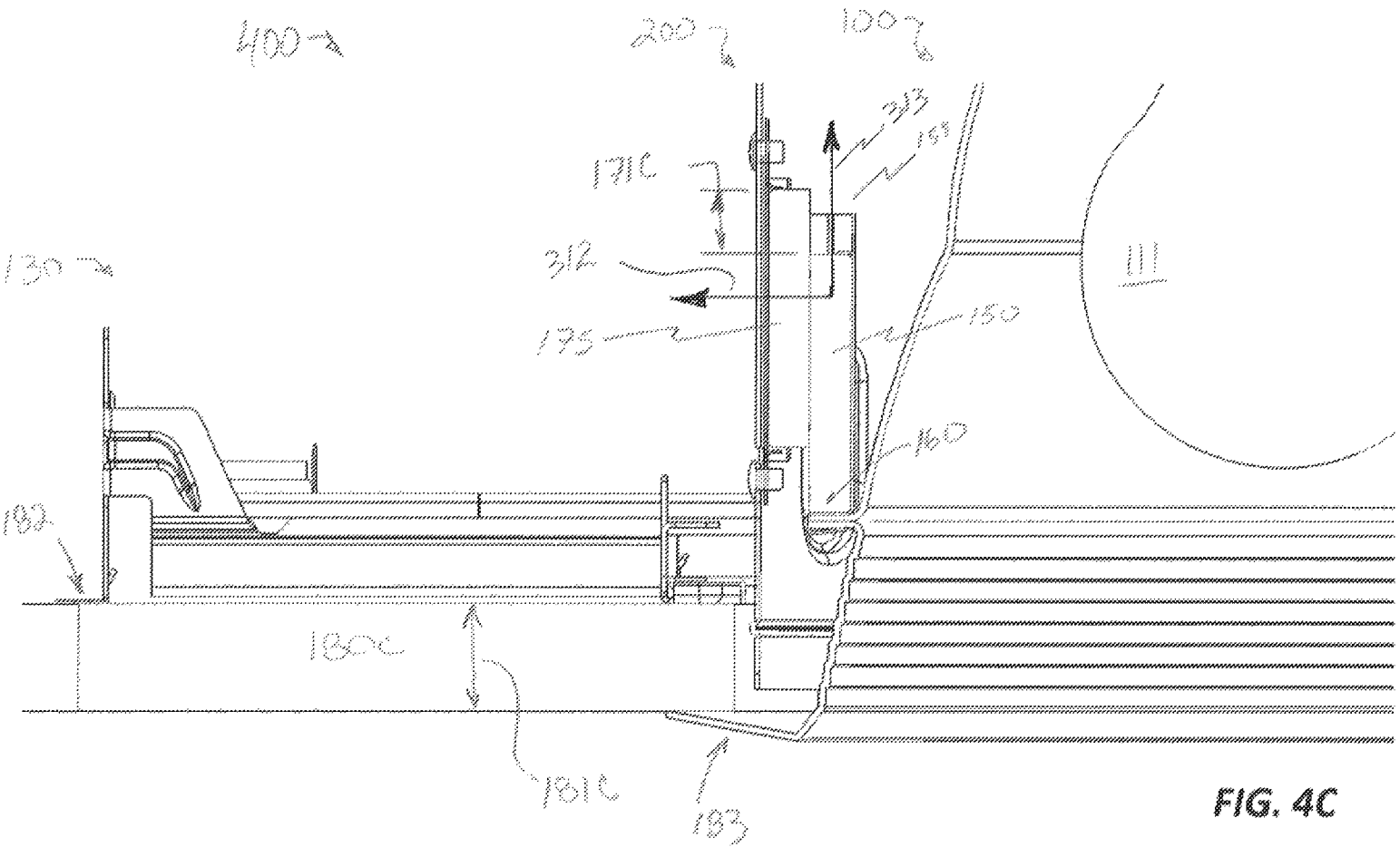

FIGS. 4A, 4B, and 4C (collectively FIG. 4) illustrate the lighting system 400 mounted to three different ceilings 180A, 180B, 180C of differing thicknesses 181A, 181B, 181C in accordance with some example embodiments of the disclosure. As further discussed below, FIG. 4 illustrates how the luminaire mounting system accommodates different ceiling thicknesses 181A, 181B, 181C.

As shown in FIG. 1, the finishing section 100 comprises a reflector 105 that extends from a rear portion to an aperture of the finishing section 100. The reflector 105 comprises a hollow tapered structure that emits light through the aperture and towards an area to be illuminated. In some embodiments, the finishing section 100 comprises or has an associated light source 111, for example as illustrated in FIGS. 2, 3, and 4. Such a light source 111 can comprise an incandescent, LED, or CFL (compact fluorescent light) bulb (as illustrated in FIGS. 2, 3 and 4) or other appropriate light engine, for example. The light source can be mounted at the upper end of the reflector 105 and towards the rear portion of the finishing section 100, so that light emits from within the hollow reflector 105 and is reflected downward through the aperture of the finishing section 100. The light source can be disposed inside the reflector 105, as illustrated, or above the reflector. In the illustrated example embodiment, the reflector 105 is rotationally symmetric about an axis 33, and the light source may be mounted on that axis 33.

As illustrated in FIG. 1, the lower portion of the reflector 105 comprises a flange 183, which seats against a lower side of the ceiling 180 as will be further discussed below. The finishing section 100 can be composed of aluminum or other appropriate material, for example.

A magnet 150 is mounted to the side of the reflector 105 via a clip 160 that comprises a spring in the illustrated embodiment. The clip 160 is clipped onto a protruding ring 161 on the exterior of the reflector 105 and is attached to the magnet 150, for example via one or more fasteners, press fit, crimping, adhesive, or other appropriate attachment means. The illustrated clip 160 has sufficient flexibility to allow the magnet 150 to pivot with respect to the axis 33. In the relaxed position illustrated in FIG. 1, the magnet 150 can be parallel to the axis 33. Once subject to repelling magnetic force (as further discussed below), the magnet 150 can tilt relative to the axis 33 due to flexing of the clip 160.

In the illustrated example embodiment, a guide 155 is attached to the upper end of the magnet 150. In some embodiments, the guide 155 and the clip 160 are a single element formed of a common piece of material. In other embodiments, the guide 155 and the clip 160 are formed separately and joined to one another.

The guide 155 and the magnet 150 can be attached together, using one or more fasteners, press fit, crimping, adhesive, or other appropriate attachment means, for example. The guide 155 forms a channel that helps guide the magnet 150 relative to another magnet 175 that is attached to the housing 200, which receives the finishing section 100, as best illustrated in FIGS. 2 and 3. The housing 200 is mounted above the ceiling 180 and has an associated frame 130 that is positioned against the upper surface of the ceiling 180. The housing 200 defines a cavity with a bottom end and a top end. In the embodiment illustrated in FIG. 3, the housing is open at a bottom end of the housing 200 and closed at a top end of the housing 200. However in alternate embodiments, the housing can take other forms and can be open at both the top and the bottom. In the example embodiment of FIGS. 1-4, the magnet 175 is attached to the inside of the housing 200 and the housing cavity is designed to receive the finishing section 100 through the opening at the bottom end of the housing 200.

In the illustrated example embodiment and as best seen in FIGS. 1 and 2A, the magnet 150 has a north pole that is oriented up, while the magnet 175 has a north pole that is oriented down. Thus, the two north poles face one another and repel one another as the finishing section 100 is inserted into the housing 200 as illustrated in FIGS. 2A and 3A. Alternatively, the magnet 150 can have a south pole that is oriented up, while the magnet 175 has a south pole that is oriented down. In both of these example embodiments, two like, repelling poles face one another as the finishing section 100 is inserted into the housing 200.

As shown in the progressive insertion illustrations of FIGS. 2 and 3, when an installer inserts the finishing section 100 into the housing 200, the guide 155 positions over the magnet 175 that is attached to the housing 200. During insertion of the finishing section 100 into the housing 200, the guide 155 slides over the magnet 175 that is attached to the housing 200. In various example embodiments, the guide 155 can be formed of metallic or nonmetallic material, for example steel, iron, aluminum, copper, plastic, fiberglass, or some other appropriate material. While the guide 155 is optional or absent in some embodiments, it can help align the magnets 175, 150 and can facilitate a controlled force interaction between the magnets 175, 150.

As illustrated in FIGS. 2 and 3, during installation, the finishing section 100 progressively moves into the housing 200 along the axis 33, with insertion force 305 applied upward. At the initial stage of finishing section insertion, as best seen in FIGS. 2A and 3A, the rear portion of the finishing section 100 has been inserted into the cavity of the housing 200 and the two north poles of the magnets 150, 170 face one another and thus are oriented to repel one another. The two north poles of the magnets 150, 175 thus repel one another as the insertion progresses.

As illustrated in FIGS. 2B and 3B, the repelling magnetic force causes the upper end of the magnet 150 to move inward towards the axis 33, in the indicated direction 310. The force further causes the clip 160 to pivot or rotate in the indicated rotational direction 311. Accordingly, the magnet 150 pivots so that the upper end of the magnet 150 swings towards the axis 33, with the axis of rotation being at or adjacent the clip 160.

As best seen in FIGS. 2C and 3C, once the finishing section 100 is inserted in the housing 200 to a depth, the magnetic forces change from magnetic repulsion to magnetic attraction and the two magnets 175, 150 are drawn together. More specifically, in the illustrated example, the north pole of the magnet 150 is attracted to the south pole of the magnet 175. Similarly, the south pole of the magnet 175 is attracted to the north pole of the magnet 150. The magnetic attraction produces a force that can be represented as two force components in the indicated directions 312, 313. That is, the applied magnetic force can be characterized as a vector sum of two orthonormal forces 312, 313—one 313 substantially parallel to the axis 33, and the other 312 substantially perpendicular to the axis 33. The vector force 312 produces rotation of the magnet 150 in the direction 316 about an axis that extends through the clip 160, and the vector force 313 pulls the finishing section 100 up into the housing 200 along the axis 33.

Accordingly, during insertion of the finishing section 100, the magnet 150 pivots inward towards the axis 33 as discussed above, so that the insertion can continue unobstructed. But as the insertion of the finishing section 100 proceeds, the respective north and south poles of the magnets 175, 150 begin to attract one another. The magnets 175, 150 are then drawn together, and the clip 160 pivots back in the indicated direction 316 as illustrated in FIG. 3C. In this manner, the finishing section 100 is pulled up so that the flange 183 is positioned against the lower surface of the ceiling 180, and the finishing section 100 is retained in the housing 200.

As best seen in FIGS. 4A, 4B, and 4C, the example luminaire mounting system accommodates ceilings 180A, 180B, 180C that have different thicknesses 181A, 181B, 181C. For each of the different-thickness ceilings 180A, 180B, 180C, the flange 183 of the finishing section 100 is pulled up to and adjoins the lower ceiling surface by the force component 313 that is substantially parallel to the axis 33, while the shoulder 182 of the housing frame 130 rests against or is pulled down towards the upper ceiling surface. Thus in each case, the ceiling 180A, 180B, 180C is disposed between a portion of the housing frame 130 and the flange 183.

For the ceiling 180A of FIG. 4A, the upper ends of the magnets 150, 175 are displaced a distance 171A determined by or corresponding to the thickness 181A of the ceiling 180A. And for the ceiling 180B of FIG. 4B, the upper ends of the magnets 150, 175 are displaced a distance 171B determined by or corresponding to the thickness 181B of the ceiling 180B. Similarly for the ceiling 180C of FIG. 4C, the upper ends of the magnets 150, 175 are displaced a distance 171C determined by or corresponding to the thickness 181C of the ceiling 180C. The two magnets 150, 175 thus provide a vertical displacement range that accommodates a corresponding range of ceiling thicknesses. FIG. 4 illustrates three example values 171A, 171B, 171C within that vertical magnet displacement range, along with three corresponding example values 181A, 181B, 181C within that ceiling thickness range.

Figure 5B:
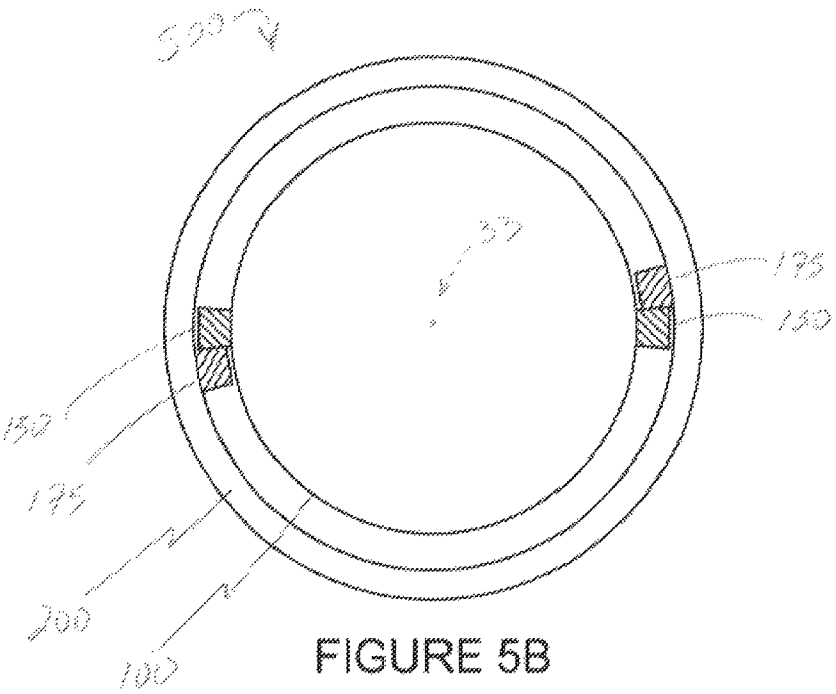
FIGS. 5A and 5B illustrate another embodiment of a luminaire mounting system in accordance with example embodiments of the present disclosure.
Figure 5A:
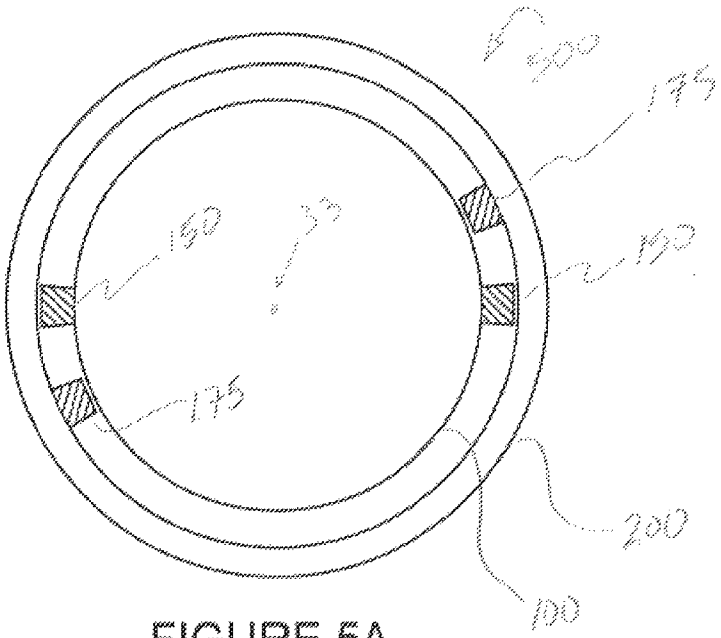

Turning now to FIGS. 5A and 5B (collectively FIG. 5) another embodiment of a lighting system 500 that comprises a luminaire mounting system is illustrated in schematic form in an overhead view. FIG. 5A illustrates the finishing section 100 as initially inserted in the housing 200, while FIG. 5B illustrates the finishing section 100 fully inserted and rotated into a long-term operating orientation. Long-term operating orientation means a position where the finishing section 100 is completely installed so that the lighting system is ready for use.

When the installer first inserts the finishing section 100 into the housing 200, the finishing section 100 is in a rotational orientation about the axis 33 in which the magnets 150, 175 are circumferentially separated from one another. Thus, magnetic force is low in the configuration illustrated in FIG. 5A. Once the installer fully inserts the finishing section 100 into the housing 200, the installer rotates the finishing section 100 about the axis 33 until the magnets 150, 175 attract one another and pull together as illustrated in FIG. 5B. With the magnets 150, 175 adjoining one another, the rotational position is retained. With the magnets 150, 175 in this orientation, the south pole of the magnet 150 is adjacent the north pole of the magnet 175, but with some longitudinal offset along the axis 33 so that magnetic attraction applies a force in a direction parallel to the axis 33. Similarly, the north pole of the magnet 150 is adjacent the south pole of the magnet 175, but with some longitudinal offset along the axis 33 so that magnetic attraction applies a force in a direction parallel to the axis 33. The applied magnetic force along the axis 33 can urge the finishing section 100 into the housing 200. Accordingly, the lighting system 5B can be installed and secured for long-term operation.

Figure 6B:
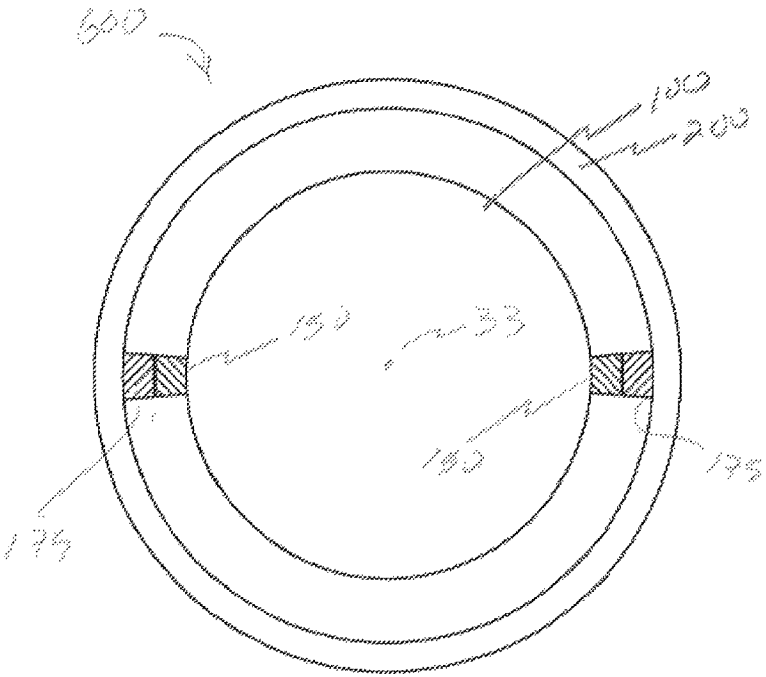
FIGS. 6A and 6B illustrate yet another embodiment of a luminaire mounting system in accordance with example embodiments of the present disclosure.
Figure 6A:
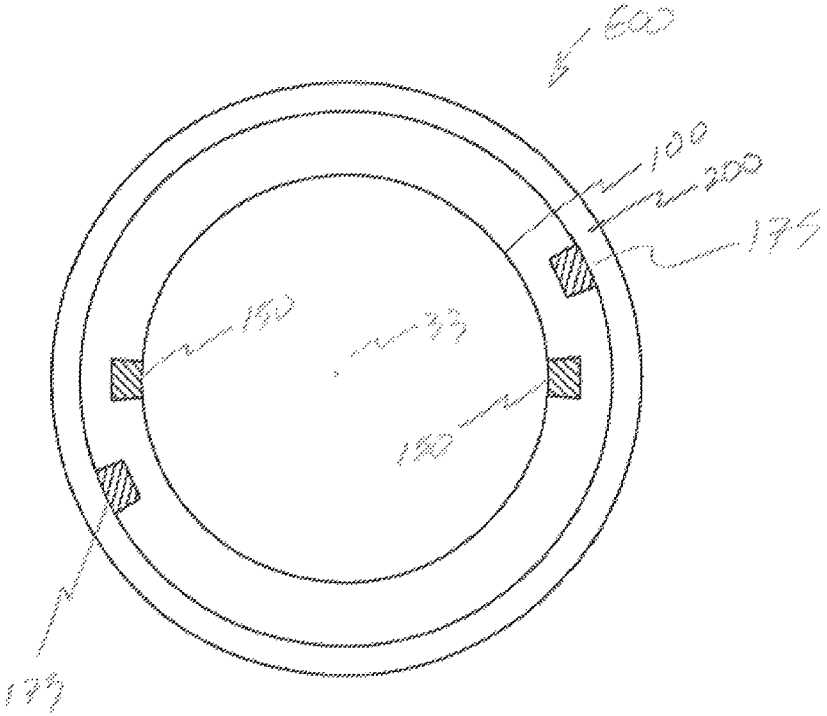

Turning now to FIGS. 6A and 6B (collectively FIG. 6) another embodiment of a lighting system 600 that comprises a luminaire mounting system is illustrated in schematic form in an overhead view. FIG. 6A illustrates the finishing section 100 as initially inserted in the housing 200, while FIG. 6B illustrates the finishing section 100 fully inserted and rotated into a long-term operating orientation.

During installation, the installer inserts the finishing section 100 into the housing 200 and rotates the finishing section 100 until magnetic force holds the magnets 150, 175 together. As discussed above with reference to the embodiment of FIG. 5, longitudinal offset between the magnets 150, 175 pulls the finishing section 100 into the housing 200. However, the embodiment of FIG. 6 has a different physical magnet geometry. When the lighting system 600 of FIG. 6 is fully installed, the circumferentially outer surface of the magnet 150, which is attached to the finishing section 100, adjoins the circumferentially inner surface of the magnet 175, which is attached to the housing 200.

In addition to a different physical geometry, the embodiment of FIG. 6 supports a different magnetic pole geometry than described above with reference to FIGS. 1, 2, 3, 4, and 5. In the embodiment of FIG. 6, the magnet 150 can have a south pole that faces inward, towards the axis 33, and a north pole that faces outward, away from the axis 33. And, the magnet 175 can have a south pole that faces inward, towards the axis 33, and a north pole that faces outward, away from the axis 33. In this configuration, the north pole of the magnet 150 adjoins the south pole of the magnet 175 when the installer fully installs the lighting system 600 and places it in its long-term, operational configuration. Accordingly, in some embodiments such as the examples illustrated in FIGS. 1-5, magnetic field lines run along or substantially parallel to the axis 33, while in other embodiments such as the example of FIG. 6, magnetic field lines run radially or substantially perpendicular to the axis 33.

Figure 7A:
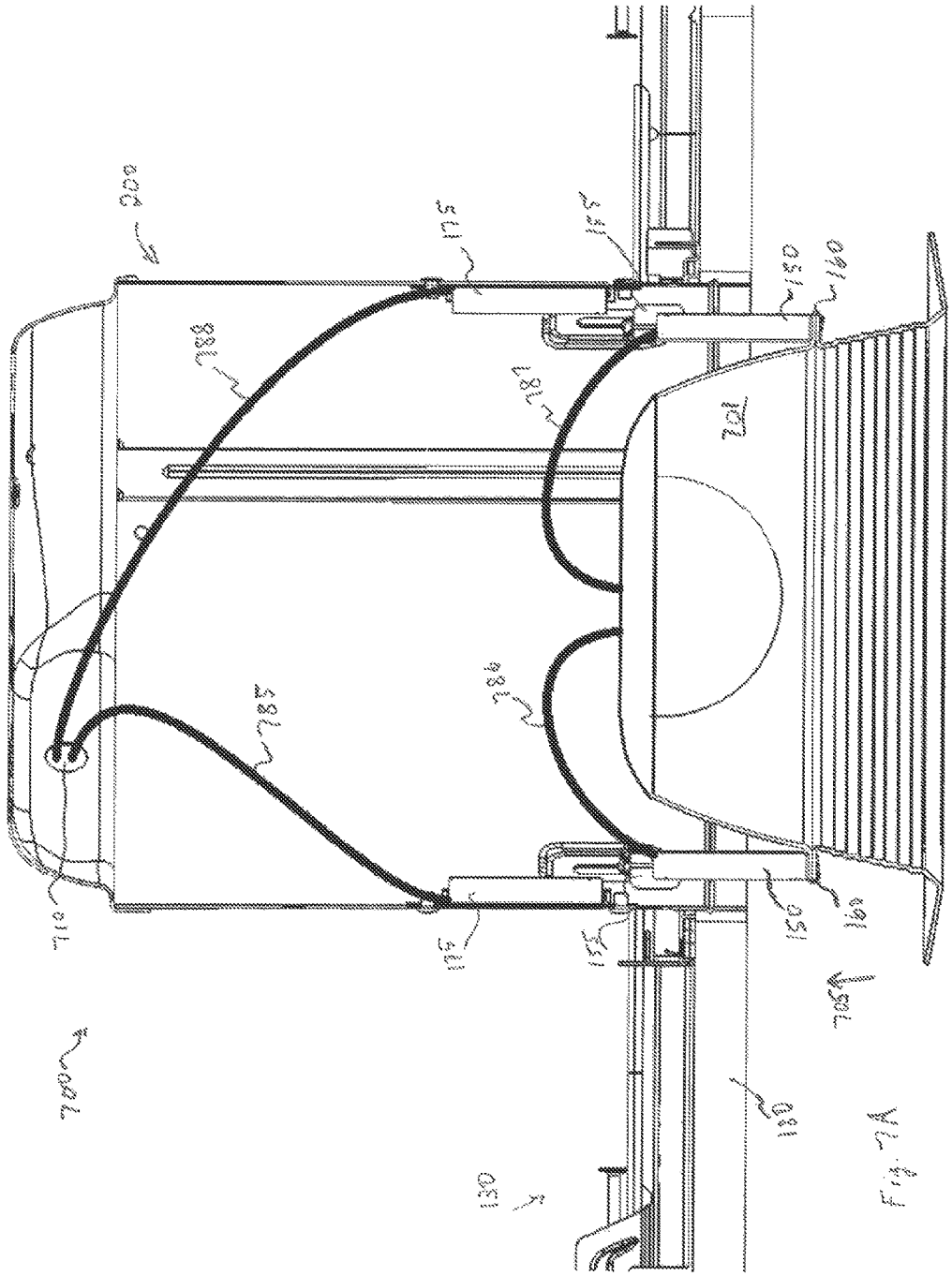
FIGS. 7A and 7B illustrate side cross-sectional views of a finishing section progressively inserted into a housing in accordance with yet another example embodiment of the present disclosure.
Figures 7A, 7B:
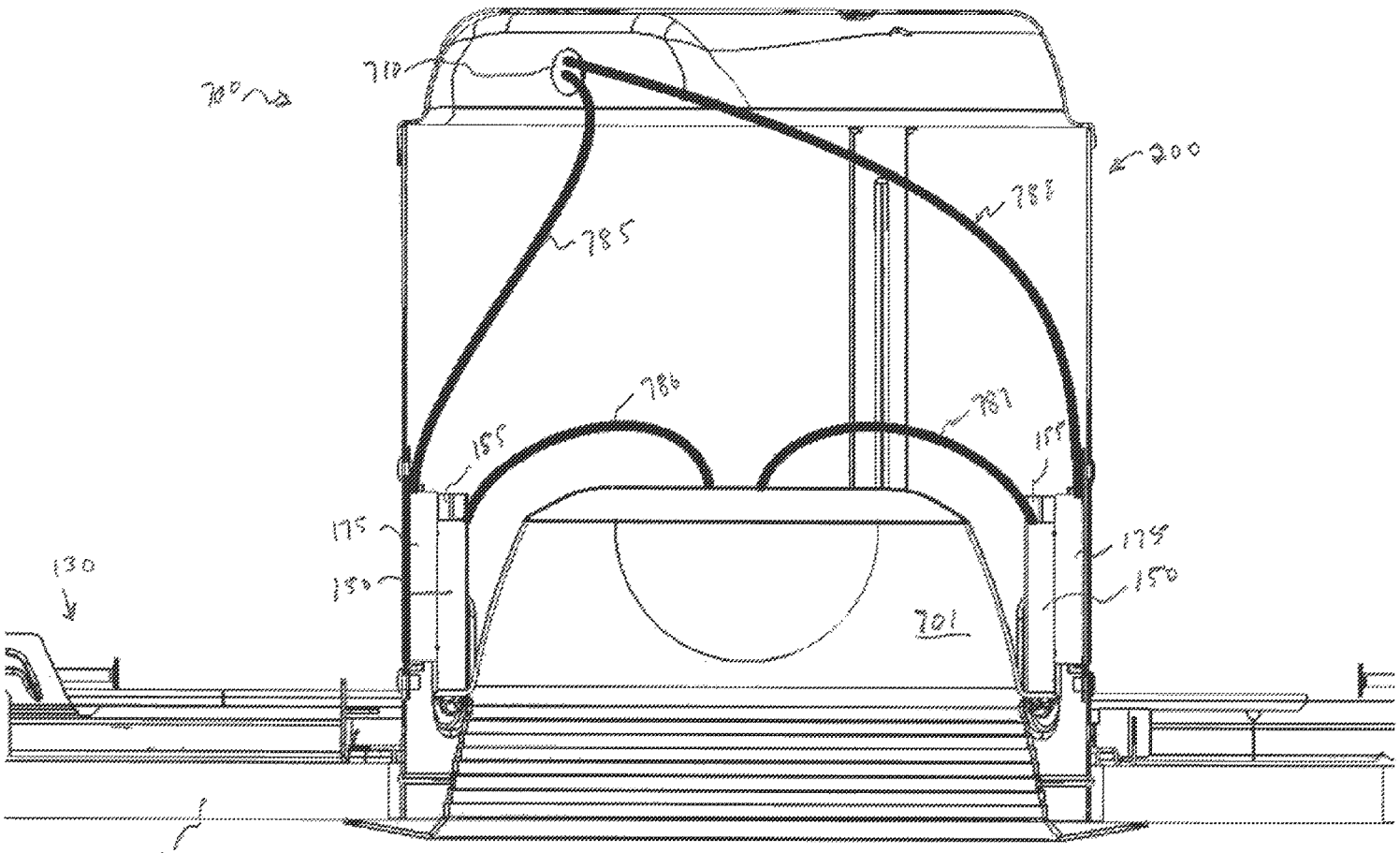

Turning now to FIGS. 7A and 7B (collectively FIG. 7) another example embodiment of a lighting system 700 that comprises a luminaire mounting system is illustrated from a side cross-sectional view. Lighting system 700 is similar to lighting system 400 illustrated in FIGS. 1-4. Accordingly, components shown in lighting system 700 that are the same or similar to components shown in lighting system 400 are given the same reference number and the description of those components will not be repeated. Similar to FIGS. 2 and 3, FIGS. 7A and 7B illustrate a finishing section 701 progressively inserted into housing 200. In FIG. 7A, as insertion force 705 is applied upward on finishing section 701, a rear portion of finishing section 701 is inserted into the cavity defined by the housing 200. As finishing section 701 moves farther into the housing 200, the top portions of magnets 150 located on each side of finishing section 701 are repelled by a magnetic force from the bottom portions of magnets 175 located on the inner surface of the housing 200. This repelling magnetic force causes the magnets 150 to pivot inward toward the center of the finishing section 701 as described above in connection with FIGS. 2B and 3B. FIG. 7B shows the finishing section 701 completely installed in the housing 200, similar to the arrangement shown in FIGS. 2C and 3C. In FIG. 7B, magnets 150 are magnetically attracted to and in contact with a corresponding magnets 175 attached to the housing 200.

The example embodiment illustrated in FIGS. 7A and 7B differs from the embodiment illustrated in FIGS. 1-4 in that the magnets 150 and 175 can also be used to supply electricity, including electrical signals and electrical power, to the finishing section 701 because the magnets 150 and 175 are made of electrically conductive material. The electricity supplied to the finishing section 701 can be used for a variety of purposes including communicating electrical signals, supplying power to a light source in the finishing section 701, and/or supplying power to sensors, processors, or other components that may be attached to or located within the finishing section 701. The electricity is supplied via wires 785, 786, 787, and 788. Specifically, wires 785 and 788 can pass through aperture 710 in housing 200 and a first end of wires 785 and 788 can be coupled to an electrical source such as a driver, ballast or other low voltage power supply located outside the housing 200. A second end of wires 785 and 788 attaches to magnets 175 as shown in FIGS. 7A and 7B. Wires 786 and 787 attach at a first end to magnets 150 and at a second end to contacts or terminals on the finishing section 701.

In this arrangement, electricity can be supplied to the finishing section 701 via wires 785, 786, 787, and 788 when the finishing section 701 is installed in the housing 200 and the magnets 150 and 175 are in contact. In the embodiment shown in FIGS. 7A and 7B, insulating material positioned between the magnets 175 and the housing 200 electrically isolate the magnets 175 from the housing 200. Similarly, the magnets 150 would be electrically isolated, for example, by making the clips 160 and/or the finishing section 701 with non-conductive material such as plastic. In an alternate version of the embodiment shown in FIG. 7 where a driver is incorporated into the finishing section 701 and line voltage is provided to the driver via wires 785, 786, 787, and 788, the contacts on the finishing section 701 to which wires 786 and 787 attach are polarized and protected from unintentional access.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lighting system comprising:

a housing that comprises a cavity disposed between a top end of the housing and a bottom end of the housing;

a finishing section sized for insertion in the cavity, the finishing section comprising a trim that extends out from the bottom end of the housing when the finishing section is completely inserted in the cavity;

a first magnet that is mounted in the cavity of the housing so that a first pole of the first magnet is oriented towards the bottom end of the housing; and a second magnet that is mounted to the finishing section so that a second pole of the second magnet is oriented towards the top end of the housing when the finishing section is positioned in the cavity, wherein the first pole and the second pole repel one another, and wherein the second magnet is mounted to the finishing section with a flexible member so that the second magnet pivots toward a center of the finishing section when the first pole and the second pole repel one another and wherein the second magnet pivots away from the center of the finishing section and attaches to the first magnet when the finishing section is completely inserted in the cavity.

2. The lighting system of claim 1, wherein the first pole comprises a north pole, and where the second pole comprises another north pole.

3. The lighting system of claim 1, wherein the first pole comprises a south pole, and where the second pole comprises another south pole.

4. The lighting system of claim 1, further comprising:

a third magnet that is mounted to the finishing section;

a fourth magnet that is mounted in the cavity of the housing;

a first wire connected to the first magnet and configured to connect to an electrical source;

a second wire connected to the second magnet and the finishing section;

a third wire connected to the finishing section and the third magnet; and a fourth wire connected to the fourth magnet and configured to connect to the electrical source, wherein the first, second, third, and fourth wires are configured to conduct electricity to the finishing section.

5. The lighting system of claim 1, wherein the first magnet and the second magnets are permanent magnets.

6. The lighting system of claim 1, wherein the first magnet comprises a first north pole and a first south pole, wherein the first pole comprises the first north pole or the first south pole, wherein the second magnet comprises a second north pole and a second south pole, wherein the second pole comprises the second north pole or the second south pole, wherein when the finishing section is fully inserted in the cavity, the first north pole adjoins the second south pole and the first south pole adjoins the second north pole.

7. A lighting system comprising:

a housing comprising:

a cavity that extends along an axis between a bottom end of the housing and a top end of the housing, the cavity sized to receive at least a rear portion of a finishing section; and a first magnet that comprises a first end and a second end, wherein the first end and the second end have opposing magnetic polarities, wherein the first magnet is mounted in the cavity so that the first end and the second end are displaced from one another along the axis with the first end oriented towards the bottom end and the second end oriented towards the top end; and the finishing section, comprising:

the rear portion;

a light source;

an aperture for emitting light produced by the light source;

a side that extends between the rear portion and the aperture; and a second magnet that comprises a third end and a fourth end, wherein the third end and the fourth end have opposing magnetic polarities, and wherein the second magnet is mounted adjacent the side with the third end oriented towards the aperture and the fourth end oriented towards the rear portion of the finishing section, wherein the first end of the first magnet and the fourth end of the second magnet have common magnetic polarities so as to repel one another, and wherein the finishing section and the housing are configured for:

insertion of the finishing section in the cavity with the axis extending between the rear portion of the finishing section and the aperture of the finishing section, with the finishing section in a first rotational position about the axis, and rotation of the inserted finishing section from the first rotational position about the axis to a second rotational position about the axis, wherein the first magnet is separated from the second magnet in the first rotational position, and wherein the first magnet adjoins the second magnet in the second rotational position.

8. The lighting system of claim 7, wherein the finishing section and the housing are configured so that when the finishing section is fully inserted in the cavity, the first end of the first magnet adjoins the third end of the second magnet and the second end of the first magnet adjoins the fourth end of the second magnet.

9. The lighting system of claim 7, wherein the first end of the first magnet comprises a north pole, and wherein the fourth end of the second magnet comprises another north pole.

10. The lighting system of claim 7, wherein the first end of the first magnet comprises a south pole, and wherein the fourth end of the second magnet comprises another south pole.

11. The lighting system of claim 7, further comprising:

a third magnet that is mounted to the finishing section;

a fourth magnet that is mounted in the cavity of the housing;

a first wire connected to the first magnet and configured to connect to an electrical source;

a second wire connected to the second magnet and the finishing section;

a third wire connected to the finishing section and the third magnet; and a fourth wire connected to the fourth magnet and configured to connect to the electrical source, wherein the first, second, third, and fourth wires are configured to conduct electricity to the finishing section.

12. The lighting system of claim 7, wherein the first magnet and the second magnet are permanent magnets.

13. A lighting system comprising:

a housing that comprises a cavity;

a finishing section sized for insertion in the cavity;

a first magnet that is attached to the housing so that a first pole of the first magnet is oriented towards an opening in the cavity at a bottom of the housing; and a second magnet that is attached to the finishing section so that a second pole of the second magnet is oriented towards a top end of the housing when the finishing section is positioned in the cavity, wherein the second magnet is attached to the finishing section with a flexible member so that the second magnet pivots toward a center of the finishing section when the first pole and the second pole repel one another and wherein the second magnet pivots away from the center of the finishing section and attaches to the first magnet when the finishing section is completely inserted in the cavity.

14. The lighting system of claim 13, wherein the housing comprises a first portion configured for positioning adjacent an upper surface of a ceiling, wherein the finishing section comprises a second portion configured for positioning adjacent a lower surface of the ceiling when the finishing section is inserted in into the cavity.

15. The lighting system of claim 13, further comprising:

a third magnet that is mounted to the finishing section;

a fourth magnet that is mounted in the cavity of the housing;

a first wire connected to the first magnet and configured to connect to an electrical source;

a second wire connected to the second magnet and the finishing section;

a third wire connected to the finishing section and the third magnet; and a fourth wire connected to the fourth magnet and configured to connect to the electrical source, wherein the first, second, third, and fourth wires are configured to conduct electricity to the finishing section.

* * * * *